United States Patent [19]

Elms et al.

[11] 4,006,384

[45] Feb. 1, 1977

[54] LEAD-LAG, SERIES-SEQUENCE STARTING AND OPERATING APPARATUS FOR THREE TO SIX FLUORESCENT LAMPS

[75] Inventors: Robert T. Elms; Joseph C. Engel, both of Monroeville, Pa.

[73] Assignee: Westinghouse Electric Corporation, Pittsburgh, Pa.

[22] Filed: Jan. 6, 1976

[21] Appl. No.: 646,795

[52] U.S. Cl. ..... 315/323; 315/227 R; 315/250; 315/254; 315/324; 315/DIG. 5

[51] Int. Cl.[2] ..... H05B 41/232; H05B 41/234

[58] Field of Search ..... 315/227 R, 246, 247, 315/250, 253, 254, 312, 323, 324, DIG. 5

[56] References Cited

UNITED STATES PATENTS 3,792,310 2/1974 Crawford ..... 315/323 X

FOREIGN PATENTS OR APPLICATIONS 922,156 6/1947 France ..... 315/DIG. 5

*Primary Examiner*—Eugene La Roche
*Attorney, Agent, or Firm*—W. D. Palmer

[57] ABSTRACT

Lead-lag, series-sequence starting and operating apparatus for three to six fluorescent lamps comprises two parallel circuit branches, one of which comprises a ballast capacitor and two lamps in series for a three or four lamp apparatus or three lamps in series for a five or six lamp apparatus. The other circuit branch comprises an inductor ballast and one or two lamps in series for a three or four lamp apparatus and two or three lamps in series for a five or six lamp apparatus. An additional ballast inductor connects in series with the two parallel-connected circuits and the AC power source. Starting capacitors parallel individual lamps and means are provided for preheating the lamp electrode coils upon energization of the apparatus. In operation, the lamp electrode coils are all preheated and the lamps which are ballasted by the capacitor, which constitutes the lead circuit, then sequentially start. The ballast capacitor and the additional ballast inductor constitute a circuit which is at least partially resonant at the line frequency and the resulting increased potential drop across the operating lead circuit sequentially initiates the discharge in the lamps which are in series with the first inductor, which constitutes the lag circuit. When all lamps are operating, the electrode coil heating potential is decreased to minimize power losses. For a four lamp circuit, the cost of the apparatus is considerably less than the cost of two two-lamp rapid start ballasts which are presently used for most installations, and the power losses in the present ballast are also considerably reduced.

20 Claims, 13 Drawing Figures

LEAD-LAG, SERIES-SEQUENCE STARTING AND OPERATING APPARATUS FOR THREE TO SIX FLUORESCENT LAMPS

BACKGROUND OF THE INVENTION

This invention relates to starting and operating apparatus for low-pressure, positive-column discharge devices of the fluorescent type and, more particularly, to such apparatus for operating three, four, five or six fluorescent lamps.

The fluorescent lamp ballast art is highly developed and the most commonly used ballast, particularly for recessed fixture commerical applicatons, is the two-lamp series-sequence ballast which is generally referred to as a two-lamp rapid-start ballast. For purposes of comparison, a general sketch of this ballast is shown in FIG. 1 of the present application. Such a ballast is described in greater detail in U.S. Pat. No. 2,796,554, dated June 18, 1957.

Another type of ballast which has been used in the past is the so-called lead-lag circuit which is shown in FIG. 2 for purposes of comparison. Other types of commerical ballasts are of the so-called instant-start type such as described in U.S. Pat. No. 2,558,293, dated June 26, 1951. Ballasts designed according to this instant start principle can be either of the lead-lag type of the series-sequence type.

The patent and other literature also contains references to many hundreds of different types of ballast designs, the vast majority of which have never been commercial. A patent representative of such ballast designs, which is of some interest with respect to the present design, is U.S. Pat. No. 2,424,505, dated July 2, 1947, wherein a ballast inductor and capacitor operate at near resonance and the same inductor and a second capacitor are partially resonant at the line frequency, to ballast two individual lamps. In U.S. Pat. No. 2,719,937, dated Oct. 4, 1955, is disclosed a lead-lag type of circuit for operating two lamps in conjunction with separate heating transformers. In U.S. Pat. No. 3,754,160, dated Aug. 21, 1973, one ballast operates four individual lamps in series-parallel arrangement. In U.S. Pat. No. 3,875,459, dated Apr. 1, 1975, is disclosed a solid-state starter circuit used with a preheat fluorescent lamp.

SUMMARY OF THE INVENTION

The present apparatus is for starting and operating, at predetermined line frequency and potential, three, four, five or six fluorescent lamp means each having electrode coils connected an individual double contact member affixed to each end of each lamp. The apparatus comprises two parallel circuit branches connected across two common circuit points. One of the circuit branches comprises a first inductor means and at least one pair of output terminal means across which the double contact members of some of the lamps are adapted to be connected, with the first inductor and the lamps as connected in the one circuit branch being in series-circuit relationship. The other circuit branch comprises a ballast capacitor means and at least one pair of output terminals across which the double contact members of the remainder of the lamps are adapted to be connected, with the ballast capacitor and the lamps as connected in the other circuit branch being in series-circuit relationship. At least one of the circuit branches has at least two pairs of the output terminals in circuit in order to provide a three lamp apparatus and starting capacitor means are connected in parallel with a portion of the output terminals sequentially to apply the available starting potential across the lamps connected across each individual pair of series-connected output terminals upon energization of the apparatus, in order to sequentially start the lamps. The apparatus has input terminals which are adapted to be connected across a source of energizing potential and a second ballast inductor means is connected between one of the input terminals and one of the common circuit points in the apparatus, with the other common circuit point connected to the other of the input terminals. The ballast capacitor and the second inductor at line frequency comprise a circuit which is at least partially resonant, and means are provided for applying a small predetermined lamp electrode coil preheating potential to the output terminals upon energization of the apparatus. In its preferred form, the present apparatus is adapted to start and operate a four lamp fixture from a 277 volt 60 Hz power source.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
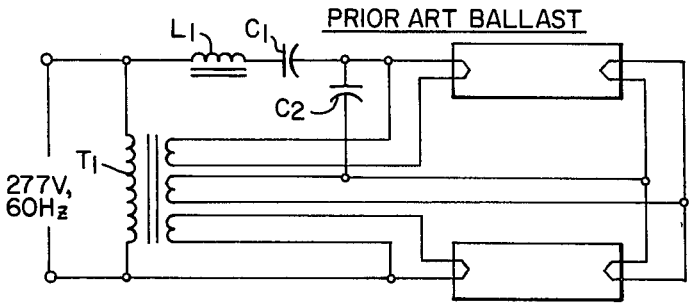
FIG. 1 is a simplified circuit diagram of a prior art two lamp series-sequence rapid-start ballast which at the present time is by far the most widely used ballast design.

In FIG. 1 is shown a typical two lamp rapid-start ballast which operates on the series-sequence principle and which, in the embodiment as shown, is designed to be operated with a rated voltage input of 277 V, 60 Hz. The majority of the commerical, recessed type fixtures which use this ballast are four lamp fixtures for 40WT12 lamps and two of the ballasts are included as a part of each fixture. The ballast as shown in FIG. 1 is a series circuit formed by $L_1$-$C_1$ and it is operated slightly below resonance, which improves the power factor and current wave shape. The transformer designated $T_1$ provides filament power and is also designed to draw from 0.07 to 0.14 ampere of magnetizing current to improve the overall ballast power factor. In the operation of the device, the lamp electrodes are preheated immediately upon energization of the ballast and the lower lamp first starts. The resulting voltage drop across capacitor $C_2$ then starts the upper lamp, after which both lamps operate in series. For the usual 40 watt lamps, the total magnetic volt-ampere rating for two two-lamp ballasts is 248 volt-amperes. A representative power loss is 12 to 15 watts for each two lamp ballast. In addition, since two ballasts are used for each four lamp fixture, two four microfarad capacitors, $C_1$, are required.

Figure 2:
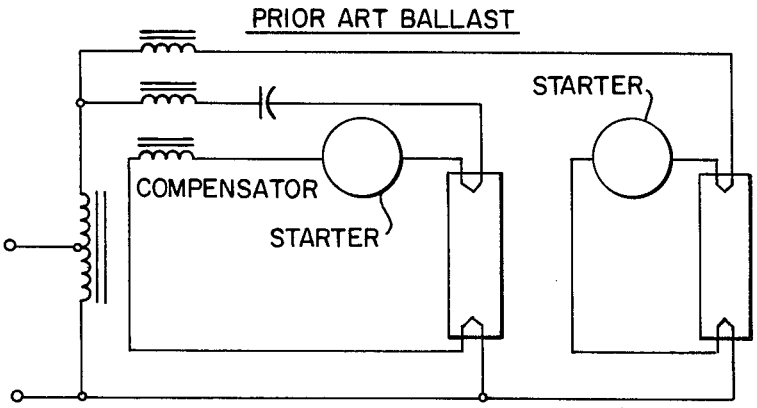
FIG. 2 is a circuit diagram of a prior art lead-lag type ballast, which preceded the rapid-start design as shown in FIG. 1.

Another prior art type of ballast is the lead-lag preheat type as is shown in FIG. 2. Each lamp has a separate ballast reactor with a capacitor connected in series with one of the reactors to provide a leading current in one lamp. Such a ballast has the advantage of providing a high power factor. The compensator is connected in series with the starting switch of the lead lamp and functions only when the lamp is starting, being cut out of the circuit when the starting switch opens.

Figure 3:
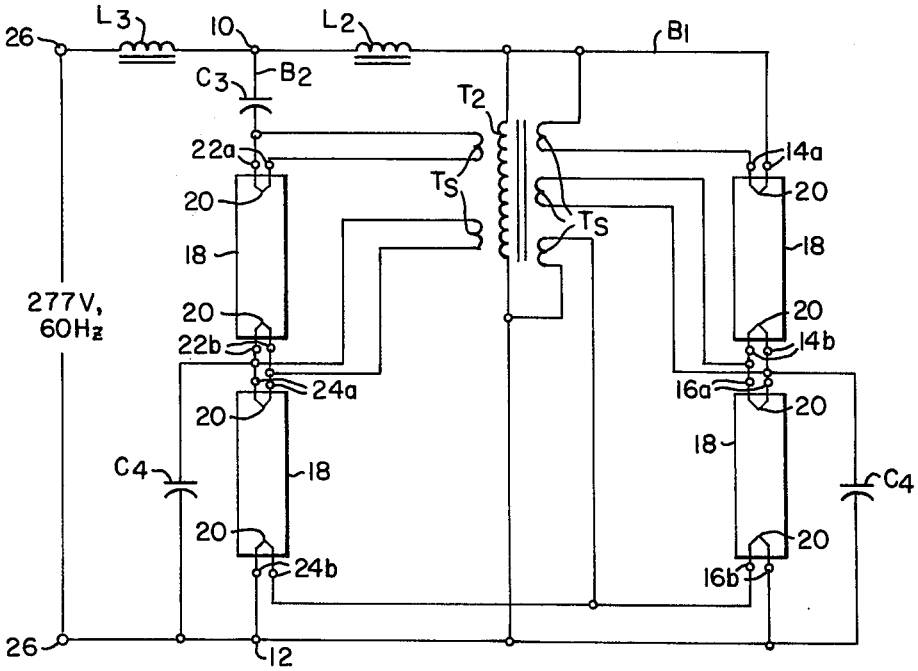
FIG. 3 is a circuit diagram of a four lamp ballast apparatus of the present invention.

The ballast of the present invention in its preferred form is shown in FIG. 3 wherein the circuit is of a lead-lag series-sequence design and is intended to operate four 40 watt fluorescent lamps. Considering this circuit in detail, the apparatus is intended to operate from an AC source of 277 volts, 60 Hz, and the apparatus comprises two parallel circuit branches which contain the lamps which are connected across two common circuit points 10 and 12. One of the circuit branches $B_1$ comprises a first inductor means designated $L_6$ (160V $\alpha$ 0.44a) and two pairs of output terminals 14*a* and 14*b* and 16*a* and 16*b* across which the 40 watt lamps 18 are adapted to be connected. These are low-pressure, positive-column, elongated discharge lamps of the fluorescent type which are adapted to be preheated prior to operating, so that each lamp has its electrode coils 20 connected to an individual double contact member which is affixed to each end of each lamp 18. The first inductor $L_2$ and the lamps 18, as connected in the first circuit branch, are in series-circuit relationship.

The other of the circuit branches $B_2$ comprises a ballast capacitor $C_3$ (4$\mu$farad, 400V) and two pairs of output terminals 22*a*, 22*b* and 24*a*, 24*b* across which the remainder of the lamps 18 are adapted to be connected, with the ballast capacitor $C_3$ and the lamps as connected in the other circuit branch $B_2$ being in series-circuit relationship. To facilitate the sequential starting of the lamps, additional starting capacitors $C_4$ are connected across one pair of each of the series connected two pairs of output terminals.

The apparatus includes input terminals 26 which are adapted to be connected across the 277 volt 60 Hz power source and a second ballast inductor $L_3$ (65V $\alpha$ 0.68a) is connected between one of the input terminals 26 and one of the common circuit points, such as 10, in the apparatus. The other of the common circuit points 12 connects to the other of the input terminals 26. The ballast capacitor $C_3$ and the second inductor $L_3$ comprise a circuit which is at least partially resonant at the 60 Hz line frequency. Of course, where applicable in other countries of the world, the circuit would be redesigned to operate at 50 Hz.

For purposes of starting, an electrode coil preheating transformer $T_2$ is provided in order that a small predetermined lamp electrode coil preheating potential is applied to each of the output terminals upon energization of the apparatus. In operation, each secondary coil of the transformer has a turns ratio to the primary of 71:1 and each of the secondary windings $T_S$ connects to output terminals, such as 14*a*, and thus to the lamp electrodes.

In the operation of the apparatus, immediately upon energization of same, a current is passed through the coil transformer $T_2$ in order to preheat the lamp electrodes 20. The lamp 18 which is not paralleled by the starting capacitor $C_4$ in the circuit branch $B_2$ is then energized by the applied potential and the resulting voltage drop across the starting capacitor $C_4$ (0.05$\mu$farad) energizes in a sequential fashion the remaining lamp 18 in the circuit branch $B_2$, with the energized lamps then operating in series relationship. The ballast inductor $L_3$ and ballast capacitor $C_3$ form a circuit which at the line frequency operates in a mode of at least partial resonance, and this generates a voltage drop across the circuit branch $B_2$ which is greater than the applied line voltage. This condition of resonance energizes in a similar sequential fashion the lamps 18 in the first circuit branch $B_1$, with the energized lamps in circuit $B_1$ then operating in series fashion. During each half cycle of operation the voltage developed across the lead circuit $B_2$ will exceed the applied line voltage, in order to insure reignition of the lamps 18 in the lag circuit $B_1$. Once the circuit is energized, however, the decreased voltage drop across the coil transformer $T_2$ will lower the electrode coil heating potential in order to conserve power.

Figure 4A:
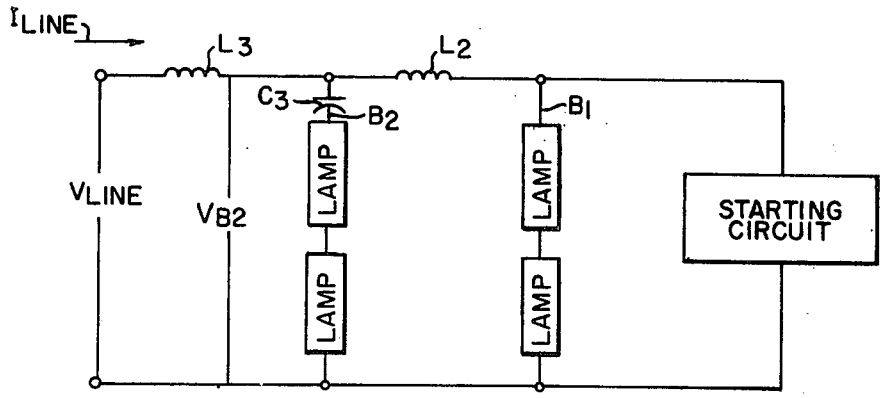
FIG. 4*a* is a simplified diagrammatic sketch of the ballast circuitry as shown in FIG. 3 and FIGS. 4*b*–4*e* represent voltage and current waveforms taken across the indicated points of the circuit as shown in FIG. 4*a*.
Figure 4B:
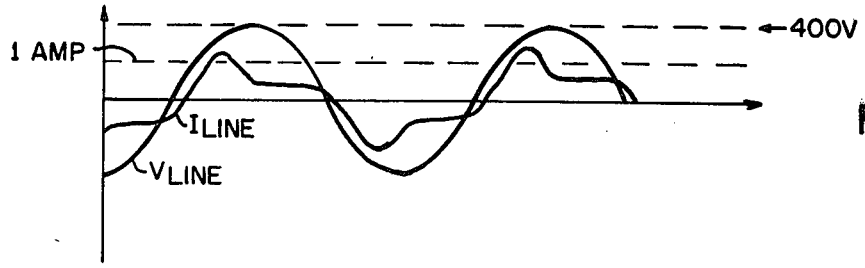
Figure 4C:
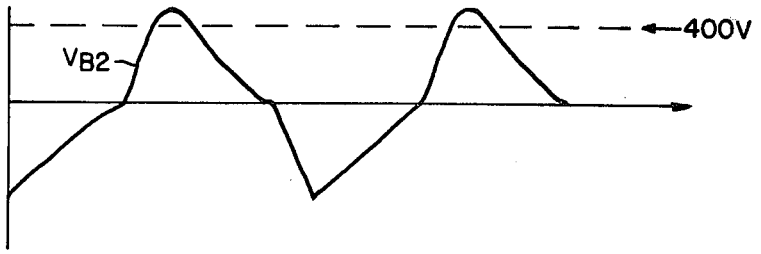
Figure 4D:
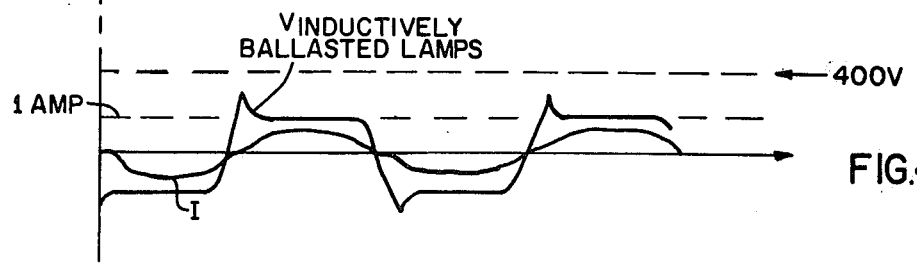
Figure 4E:
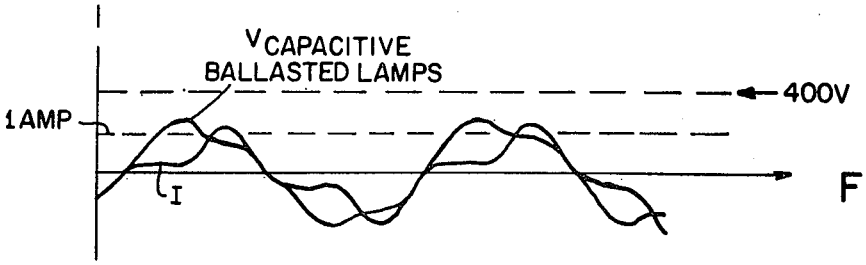

The operating characteristics for the circuit as shown in FIG. 3 are graphically illustrated in FIGS. 4*a*–4*e* wherein the circuit of FIG. 3 is diagrammatically shown in FIG. 4*a*. The applied line voltage and current waveforms are shown in FIG. 4*b*, and the maximum applied voltage is shown as 400 volts. In the operating circuit, the voltage applied across circuit branch $B_2$ exceeds the applied line voltage once during each half cycle because of the resonant mode of $L_3$-$C_3$. A representative operating peak voltage drop across circuit $B_2$ is 500 volts, see FIG. 4*c*, and during starting, the maximum voltage developed across circuit $B_2$ can be as high as 550 volts, thereby insuring ignition of the lamps 18 in the lag circuit $B_1$. The voltage and current relationships across the inductively ballasted lamps, that is, the lag circuit, are shown in FIG. 4*d* and the voltage and current relationships across the capacitively ballasted lamps, that is, the lead circuit, are shown in FIG. 4*e*.

As indicated hereinbefore, two two-lamp rapid-start ballasts normally have a total magnetic component volt-ampere rating of 248 volt-amperes. The present ballast as described hereinbefore, when designed to operate four 40 watt lamps, requires a total magnetic volt-ampere rating of 155 volt-amperes, so that there is a considerable savings in copper and iron. In addition, only one four microfarad 400 volt ballast capacitor $C_3$ is required. The actual power losses in the present four lamp 40 watt ballast are only about half the power losses in the prior art two two-lamp rapid-start ballasts. Throughout the life of the fixture, the power savings per fixture is quite substantial.

Figure 5:
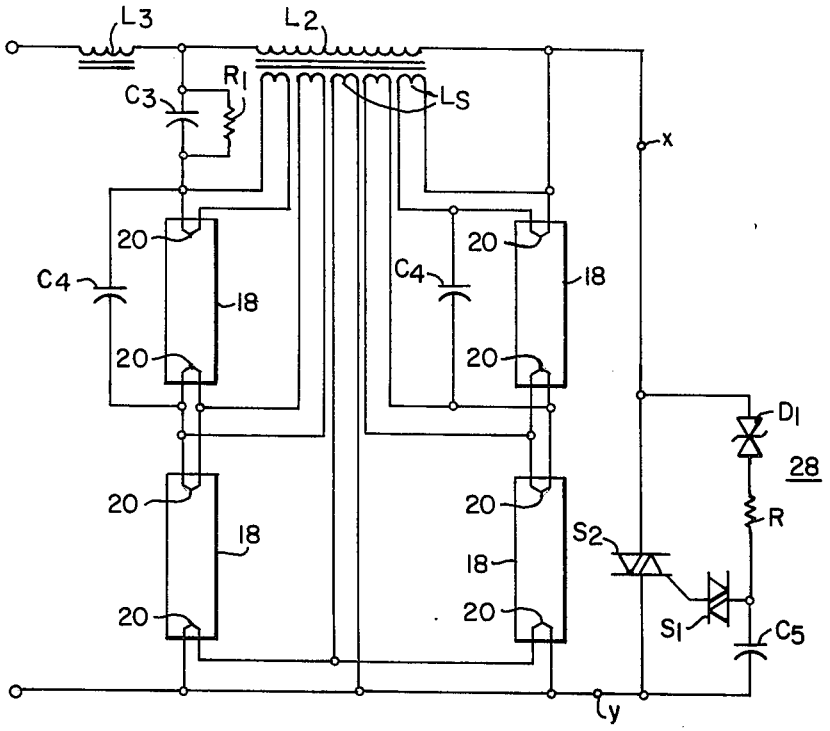
FIG. 5 is a modified form of four lamp ballast which incorporates heater coil windings in transformer relationship with one of the inductor ballasts and a separate solid-state starting circuit.

In FIG. 5 is shown a ballasting apparatus which is generally similar to that shown in FIG. 4 except that the lamp electrode coils 20 are preheated by secondary coils $L_S$ which are in transformer relationship with the inductor $L_2$. In addition, there is provided a starting circuit 28 to facilitate the lamp electrode coil preheating. In the operation of this starting circuit, the Zener diode $D_1$ conducts at 100 volts in order to charge 0.14μfarad capacitor $C_5$ through the 60 K resistor R. At 40 volts, the diac $S_1$ triggers the triac $S_2$ which conducts and causes current to flow through the inductor $L_2$ and preheat the lamp electrode coils 20, with the lamps then starting in series sequence as described for the embodiment shown in FIG. 3. After the lamps once start, the starting circuit is rendered inoperative since the capacitor $C_5$ will never charge sufficiently to apply the 40 volts across the diac to cause it to conduct. Any time the lamps in the lag circuit $B_1$ cease to operate, the circuit 28 will be operational. A 1 M resistor $R_1$ may be provided to bleed the capacitor $C_3$ when the ballast is deenergized.

Figure 6:
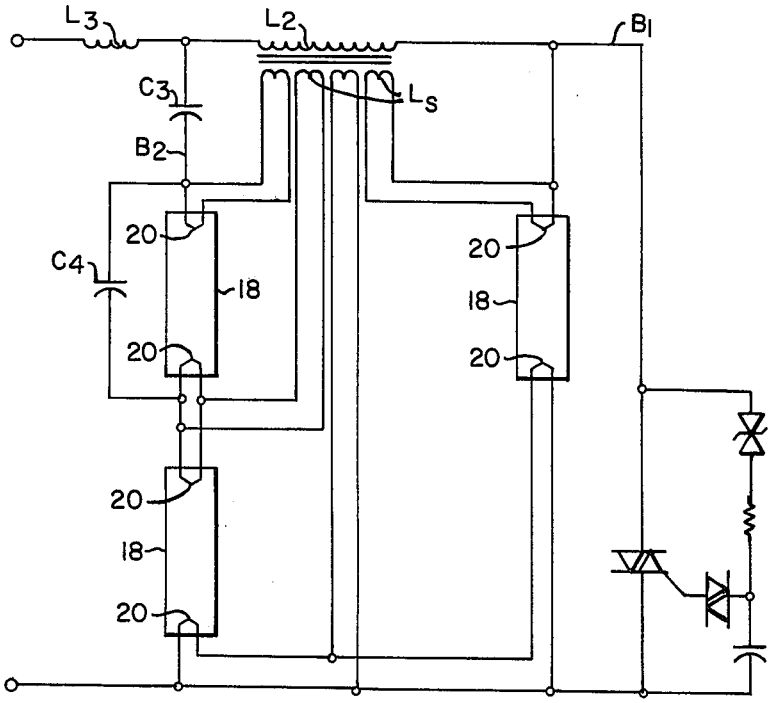
FIG. 6 is a circuit generally corresponding to that shown in FIG. 5 except that it is modified to operate three fluorescent lamps.

The apparatus as shown in FIG. 5 is readily modified to convert it to a three lamp ballast and such a modified apparatus is shown in FIG. 6, which is identical to that as shown in FIG. 5 except that one lamp 18 is eliminated along with one secondary coil $L_S$. The lamp eliminated is preferably taken from the lag circuit $B_1$ to avoid any tendency for instant starting in the lead circuit $B_2$, which might occur if the lamp were taken from the lead circuit. This modification is considered to be quite practical from a commerical standpoint since present three lamp fixtures normally incorporate one two-lamp fluorescent ballast and one separate one-lamp ballast.

Figure 7:
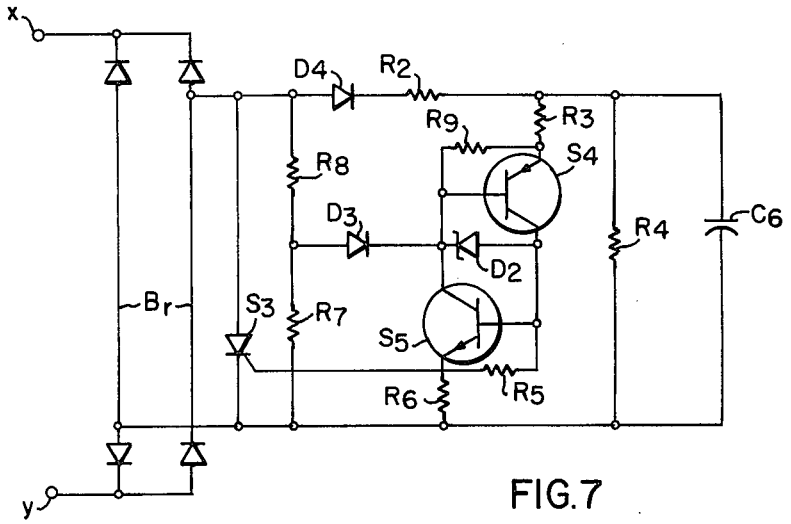
FIG. 7 is a modified starting circuit which is adapted to operate in conjunction with the ballast apparatus shown in FIGS. 5 and 6.

In FIG. 7 is shown an alternative starting circuit which can be connected into the points X–Y as shown in FIG. 5. This modified circuit provides a full on-off action across the lamps in the lag circuit until starting occurs. This arrangement provides approximately 3.9 volts to each lamp electrode coil 20 until the lamp is started and the filament voltage is then reduced to about 2.9 volts. In the operation of the circuit as shown in FIG. 7, the diode bridge Br rectifies the supply potential and the 10 microfarad capacitor $C_6$ is charged through the 1 M resistor $R_2$ and discharged through the 100 K resistor $R_3$ to cause the preheating current to flow through $L_2$ (see FIG. 5) and thence to the electrode coils. The discharging time is about 2 seconds. Whenever the terminal voltage exceeds approximately 250 volts, the thyristor $S_3$ is triggered through the two transistors $S_4$, $S_5$ which serve as trigger current amplifiers. This in effect applies a short circuit between the terminals X and Y until the lamps start. After the lamps start, the voltage applied across X and y drops to about 210 volts AC, which is sufficient to cause the circuit to trigger. Typical components which can be used in the circuit shown in FIG. 7 are as follows:

| Component | Identification or Valve |
|---|---|
| Bridge | 1 A, 400 V |
| $S_3$ | 1.5 A, 400 V |
| $S_4$ | 2N2907 |
| $S_5$ | 2N930 |
| $D_2$ | 40 V |
| $D_3$, $D_4$ | 1N457 |
| $R_2$ | 1 M |
| $R_3$ | 100 K |
| $R_4$ | 230 K |
| $R_5$ | 47 K |
| $R_6$ | 5.1 K |
| $R_7$ | 20 K |
| $R_8$ | 100 K |
| $R_9$ | 47 K |

-continued

| Component | Identification or Valve |
|---|---|
| $C_6$ | 10 microfarad, 50 V |

Figure 8:
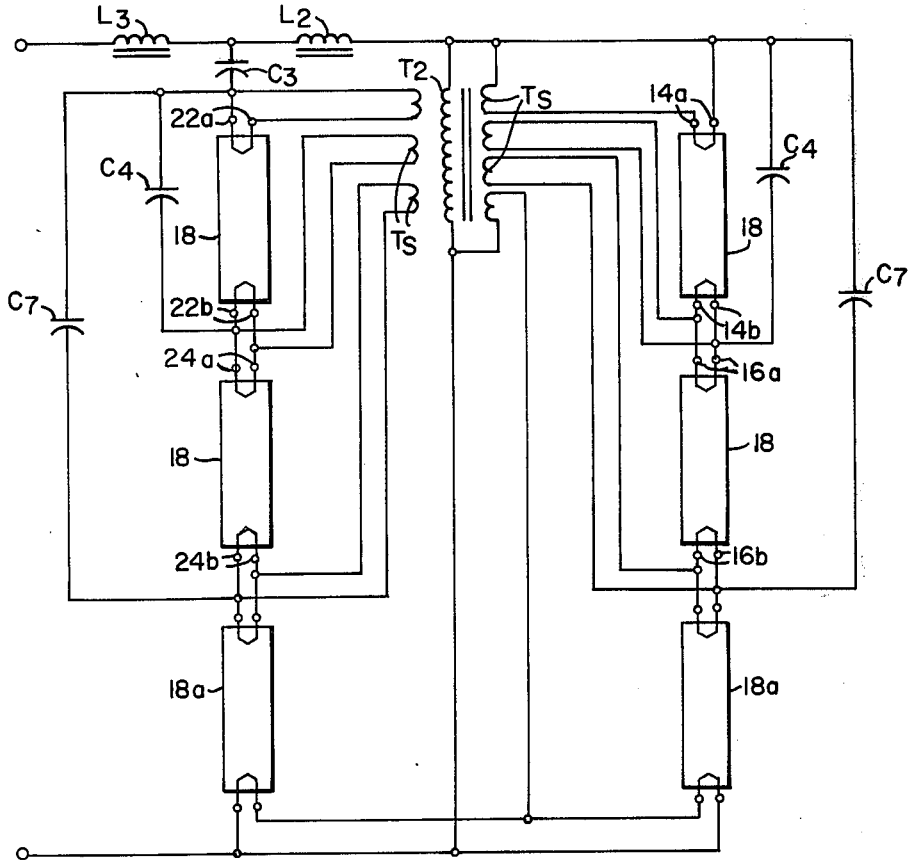
FIG. 8 is a ballast apparatus which is designed to operate six fluorescent lamps in accordance with the present invention.

In FIG. 8 is shown an operating apparatus for six lamps. This apparatus generally corresponds to that apparatus as shown in FIG. 3 and described hereinbefore except that two more filament coil transformers $T_S$ are added and one more lamp 18*a* is connected in series in each circuit. The starting capacitors $C_4$ are identical to those as used in the apparatus shown in FIG. 3 and these in turn are paralleled by supplemental starting capacitors $C_7$ so that the starting capacitors are connected in parallel with a portion of each of the series-connected output terminals, sequentially to apply the available starting potential across each individual pair of series-connected output terminals upon energization of the apparatus, thereby to sequentially start the lamps as connected across the output terminals. In the circuit as shown in FIG. 8, each of the three pairs of output terminals in each circuit branch have a first individual starting capacitor $C_7$ (0.065μfarad) connected in parallel with two of the pairs of output terminals, and the additional individual starting capacitors $C_4$ are connected in parallel with one of the pairs of the output terminals which is paralled by the first starting capacitor $C_7$.

Figure 9:
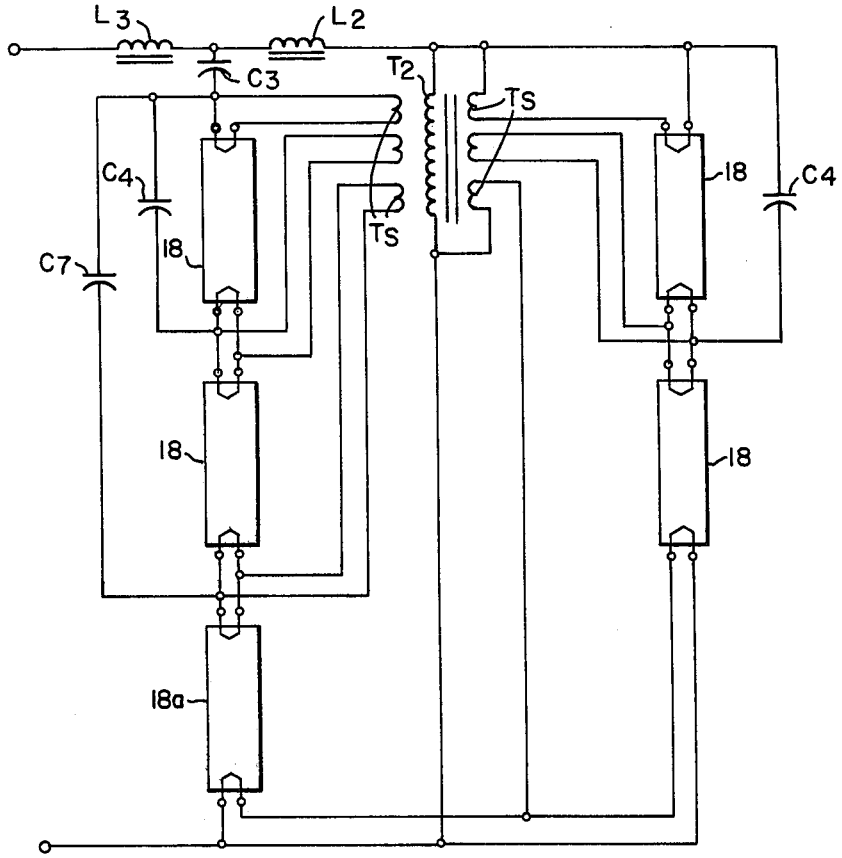
FIG. 9 is a ballast apparatus generally corresponding to that shown in FIG. 8 except that it is modified to operate five fluorescent lamps.

In the embodiment shown in FIG. 9, the circuit of FIG. 8 is modified to operate five fluorescent lamps by eliminating one of the lamps in the lag circuit from the embodiment shown in FIG. 8, along with one of the electrode coil heating transformers $T_S$. In addition, only one paralleling starting capacitor $C_4$ is used in the lag circuit in the manner shown in the apparatus of FIG. 3.

While ballasts have been shown which incorporate 3, 4, 5 or 6 lamps, the present ballast designs are better suited to operate with some specific lamp sizes than others. Operation is excellent with four 40 watt T12 straight-tube lamps which are rated to operate at 425 ma. and such a lamp ballast is particularly adapted to operate from 277 VAC. The three lamp version of this ballast also works excellently and the four lamp and three lamp versions of a similar lamp in a T10 size also performs well. A T12 envelope has a diameter of 12/8 inches or 1.5 inches (3.8 cm). A T10 envelope has a diameter of 10/8 inches or 1.25 inches (3.2 cm). The four lamp and three lamp versions of the so-called U-bent lamps in 40 watt T12 425 ma. size perform excellently both in the 3-⅝ inch U (9.2 cm) and the 6 inch U (15.3 cm). In five and six lamp circuits, the 800 ma. 60 inch (153 cm) T12 lamp operated at 480 VAC performs excellently and in three and four lamp circuits the 96 inch (244 cm) T12/PG12 which operates at 1500 ma. performs well in a 480 VAC four lamp version. Other lamp styles and sizes can also be operated in the present apparatus, but the foregoing appear to be the best adapted to operate in the present apparatus. Of course by far the largest commerical lamp which is marketed is the 40 watt T12 with the four lamp ballast operating at 277 VAC having more than 50% of the present existing market for commerical recessed fixtures. As in the case of most series-sequence starting and operating apparatus, it is preferred to operate the present apparatus with the lamps closely spaced from a grounded reflector, to facilitate starting.

We claim:

1. Apparatus for starting and operating from an AC source of predetermined frequency and potential three, four, five or six low-pressure, positive-column elongated discharge lamp means each having electrode coils connected to an individual double contact member affixed to each end of each said elongated discharge lamp means, said apparatus comprising:

a. two parallel circuit branches connected across two common circuit points in said apparatus, one of said circuit branches comprising a first inductor means and from one to three pairs of output terminal means across which the double contact members of some of said lamp means are adapted to be connected, with said first inductor means and said lamp means as connected in said one circuit branch being in series-circuit relationship, the other of said circuit branches comprising ballast capacitor means and from one to three pairs of output terminal means across which the double contact members of the remainder of said lamp means are adapted to be connected, with said ballast capacitor means and said lamp means as connected in said other circuit branch being in series-circuit relationship, said output terminal means in at least one of said circuit branches comprising two or three pairs of series-connected output terminals, each said pair of output terminals adapted to have the double contact members of one of said lamp means connected thereacross, and starting capacitor means connected in parallel with a portion of said series-connected output terminals sequentially to apply the available starting potential across each individual pair of said series-connected output terminals upon energization of said apparatus thereby to sequentially start said lamp means as connected thereacross;

b. input terminals adapted to be connected to said AC source of predetermined frequency and potential, second inductor ballast means connected between one of said input terminals and one of said common circuit points in said apparatus, the other of said common circuit points in said apparatus connected to the other of said input terminals, and said ballast capacitor means and said second inductor ballast means at said AC source predetermined frequency comprising a circuit which is at least partially resonant; and c. means for applying a small predetermined lamp electrode coil preheating potential to said output terminal means upon energization of said apparatus.

2. Apparatus for starting and operating from an AC source of predetermined line frequency and potential three or four low-pressure, positive-column elongated discharge lamp means each having electrode coils connected to an individual double contact member affixed to each end of each said elongated discharge lamp means, said apparatus comprising:

a. two parallel circuit branches connected across two common circuit points in said apparatus, one of said circuit branches comprising first inductor means and one or two pairs of output terminal means across which the double contact members of some of said lamp means are adapted to be connected, with said first inductor means and said lamp means as connected in said one circuit branch being in series-circuit relationship, the other of said circuit branches comprising ballast capacitor means and two pairs of output terminal means across which the double contact members of the remainder of said lamp means are adapted to be connected, with said ballast capacitor means and said lamp means as connected in said other circuit branch being in series-circuit relationship, and starting capacitor means connected across one pair of each said series-connected two pairs of output terminal means;

b. input terminals adapted to be connected to said AC source of predetermined frequency and potential, second inductor ballast means connected between one of said input terminals and one of said common circuit points in said apparatus, the other of said common circuit points in said apparatus connected to the other of said input terminals, and said ballast capacitor means and said second inductor ballast means at said AC source predetermined frequency comprising a circuit which is at least partially resonant; and c. means for applying a small predetermined lamp electrode coil preheating potential to said output terminal means upon energization of said apparatus.

3. The apparatus as specified in claim 2, wherein after said lamp means are started, said small electrode coil preheating potential as applied to said output terminal means is substantially lowered to decrease power consumption in said apparatus.

4. The apparatus as specified in claim 3, wherein said means for applying a small predetermined lamp electrode coil preheating potential to said output terminal means comprises an electrode coil transformer having a primary winding and multiple secondary windings, said primary winding connects across said two common circuit points in said apparatus, and said secondary windings connect to individual ones of said output terminal means.

5. The apparatus as specified in claim 3, wherein said means for applying a small predetermined lamp electrode coil preheating potential to said output terminal means comprises multiple small coils connected in transformer relationship to said first inductor means, said multiple small coils are connected to individual ones of said output terminal means, and a switching circuit connects across said common circuit points in said apparatus to conduct only during the period when said lamp means in said one circuit branch are not operating to cause said coil preheating potential to be applied to said output terminal means.

6. The multilamp starting and operating apparatus as specified in claim 2, wherein said ballast capacitor means and said second inductor ballast means which comprise said circuit which is at least partially resonant have such relative reactance values with respect to said AC source predetermined frequency that the maximum voltage developed across said other circuit branch during both starting and operation of said lamp means exceeds said predetermined potential of said AC source.

7. The multilamp starting and operating apparatus as specified in claim 6, wherein said AC source is rated at 480 VAC and 60 Hz.

8. The multilamp starting and operating apparatus as specified in claim 6, wherein said AC source is rated at 277 VAC and 60 Hz.

9. The apparatus for starting and operating lamp means as specified in claim 8, wherein each of said circuit branches has two pairs of output terminal means, said lamps as adapted to be connected to said output terminal means are four fluorescent lamps of 40 watt rating, and one pair of each of said two pairs of output terminal means is paralleled by a starting capacitor.

10. The apparatus as specified in claim 9, wherein said lamps are of a T10 design.

11. The apparatus as specified in claim 9, wherein said lamps are of a T12 design.

12. The apparatus as specified in claim 11, wherein said 40WT12 fluorescent lamps are of a straight-tube design.

13. Apparatus for starting and operating from an AC source of predetermined line frequency and potential five or six low-pressure, positive-column elongated discharge lamp means each having electrode coils connected to an individual double contact member affixed to each end of each said elongated discharge lamp means, said apparatus comprising:

a. two parallel circuit branches connected across two common circuit points in said apparatus, one of said circuit branches comprising a first inductor means and two or three pairs of output terminal means across which the double contact members of some of said lamp means are adapted to be connected, with said first inductor means and said lamp means as connected in said one circuit branch being in series-circuit relationship, the other of said circuit branches comprising ballast capacitor means and three pairs of output terminal means across which the double contact members of the remainder of said lamp means are adapted to be connected, with said ballast capacitor means and said lamp means as connected in said other circuit branch being in series-circuit relationship, and starting capacitor means connected in parallel with a portion of said series-connected output terminal means sequentially to apply the available starting potential across each individual pair of said series-connected output terminal means upon energization of said apparatus thereby to sequentially start said lamp means as connected thereacross;

b. input terminals adapted to be connected to an AC source of said predetermined frequency and potential, second inductor ballast means connected between one of said input terminals and one of said common circuit points in said apparatus, the other of said common circuit points in said apparatus connected to the other of said input terminals, and said ballast capacitor means and said second inductor ballast means at said AC source predetermined frequency comprising a circuit which is at least partially resonant; and c. means for applying a small predetermined lamp electrode coil preheating potential to said output terminal means upon energization of said apparatus.

14. The multilamp starting and operating apparatus as specified in claim 13, wherein said ballast capacitor means and said second inductor ballast means which comprise said circuit which is at least partially resonant have such relative reactance values with respect to said AC source predetermined frequency that the maximum voltage developed across said other circuit branch during both starting and operation of said lamp means exceeds said predetermined potential of said AC source.

15. The multilamp starting and operating apparatus as specified in claim 14, wherein said AC source is rated at 480 VAC and 60 Hz.

16. The apparatus as specified in claim 13, wherein after said lamp means are started, said small electrode coil preheating potential as applied to said output terminal means is substantially lowered to decrease power consumption in said apparatus.

17. The apparatus as specified in claim 16, wherein said means for applying a small predetermined lamp electrode coil preheating potential to said output terminal means comprises an electrode coil transformer having a primary winding and multiple secondary windings, said primary winding connects across said two common circuit points in said apparatus, and said secondary windings connect to individual ones of said output terminal means.

18. The apparatus as specified in claim 16, wherein said means for applying a small predetermined lamp electrode coil preheating potential to said output terminal means comprises multiple small coils connected in transformer relationship to said first inductor means, said multiple small coils are connected to individual ones of said output terminal means, and a switching circuit connects across said common circuit points in said apparatus to conduct only during the period when said lamp means in said one circuit branch are not operating to cause said coil preheating potential to be applied to said output terminal means.

19. The apparatus as specified in claim 13, wherein each three pairs of output terminal means in said circuit branches have a first individual starting capacitor connected in parallel with two of said pairs of output terminal means, and an additional individual starting capacitor connects in parallel with one of the pairs of said output terminal means which is paralleled by said first starting capacitor.

20. The apparatus as specified in claim 19, wherein each said circuit branch has three pairs of said output terminal means therein.

* * * * *